US005232811A

United States Patent [19]

deGraft-Johnson et al.

[11] Patent Number: 5,232,811

[45] Date of Patent: Aug. 3, 1993

[54] EASY CLEANING LIQUID ELECTROPHOTOGRAPHIC DEVELOPER

[75] Inventors: Joseph deGraft-Johnson, Naugatuck; Feagin A. Wing, Jr., Farmington, both of Conn.

[73] Assignee: Olin Corporation, Cheshire, Conn.

[21] Appl. No.: 810,080

[22] Filed: Dec. 19, 1991

[51] Int. Cl.[5] ..... G03G 9/16

[52] U.S. Cl. ..... 430/115; 430/114

[58] Field of Search ..... 430/117, 115

[56] References Cited

U.S. PATENT DOCUMENTS 4,061,582 12/1977 Moschovis et al. ..... 430/114

*Primary Examiner*—John Goodrow

*Attorney, Agent, or Firm*—William A. Simons

[57] ABSTRACT

A dyed latex liquid developer composition comprising:

(a) a carrier liquid;

(b) a dyed latex;

(c) a charge director; and (d) at least about 0.5% by weight of mineral oil, based on the total developer formulation.

12 Claims, No Drawings

EASY CLEANING LIQUID ELECTROPHOTOGRAPHIC DEVELOPER

BACKGROUND OF THE INVENTION

1. Field of The Invention

The present invention relates generally to liquid electrophotographic (or electrostatographic) developers having easy cleaning properties. In particular, the Present invention relates to nonaqueous dyed latex liquid developers that contain a selected amount of mineral oil which provides easy cleaning of equipment in which the developer is employed.

2. Brief Description of Prior Art

Liquid developer compositions are used in office copy machines, computer print-out devices, lithographic master Preparation and the like to create a visible counterpart from a latent electrostatic image. Liquid toners generally consist of five components: a carrier liquid, coloring agent, fixative agent, dispersing agent, and charge director. In any given developer composition, there may be one or more of each of these components. Also, one or more chemicals in such developer compositions may simultaneously have multiple functions. For example, a dispersing agent may also act as a fixative. Moreover, when a polymeric dispersing agent is employed, the combination of coloring agent, fixing agent, and dispersing agent is sometimes called a dyed latex toner polymer.

In the development of the electrostatic latent image to a visible image, the solid toner particles (including dyes or pigments) in the developer composition either migrate to the charged areas or the uncharged areas but not to both. If the toner particles go to the charged areas, this is called positive development. If the toner particles go to the uncharged areas, this is called reversal development. The coloring agent should be essentially insoluble in the carrier liquid and preferably contain no contaminants which are soluble therein. Dyes are selected for their solubility in the fixing agent and insolubility in the carrier liquid as well as for their color. Moreover, pigments are chosen on the basis of proper color, the best intrinsic surface or migration properties, ease of grinding to a desired fine particle size, and the differential between its specific gravity and that of the carrier liquid.

Dyes are usually employed for coloring latex toner. The resultant mixture is commonly called "a dyed latex". Dyes are incorporated therein by reacting them or by dissolving them into the latex polymer.

The fixative agent aids in the making of the toned or visual image a permanent part of the underlying substrate (e.g., paper). In a dyed latex, the fixative agent portion is generally a synthetic polymer or copolymer which has the desirable characteristics of chemical stability, an unobjectable color, and is insoluble in the liquid carrier as well as being compatible with the substrate onto which the image is deposited. There are many synthetic resins useful for this purpose.

The last component of a dyed latex liquid developer is the charge director. The charge director must be soluble or dispersible in the liquid carrier and must create or augment an electrostatic charge on micron or sub-micron toner particles. The patent literature is replete with different charge director compositions. Typical charge directors are metal salts of long chain fatty acids, both substituted and unsubstituted.

U.S. Pat. Nos. 3,753,760; 3,900,412; 3,990,980; and 3,991,266, all of which issued to Kosel and are each incorporated herein by reference in their entirety, teach the creation of a multifunctional amphipathic latex molecule which incorporates in one molecule the colorant agent, the dispersing agent, and the fixative agent. Thus, liquid latex developers as these are sometimes called, have only three components: the carrier liquid, the multifunctional latex particle ("a dyed latex"), and the charge director.

Mineral oil has been added to commercial latex-type and hybrid-type liquid developers as an optional dispersing ingredient. The amount of mineral oil added in such instances was generally less than about 0.25% by weight of the total developer formulation.

It has now been found that when mineral oil is added to a dyed latex-type or hybrid-type liquid toner in greater amounts, it acts as an antidrying agent; thus preventing the formation of a hard, dry toner film on internal machine surfaces. Therefore, machines which employ such mineral oil-containing liquid developer formulations remain cleaner and, when cleaning is desired, are easier to clean than the corresponding previously used liquid developers.

BRIEF SUMMARY OF THE INVENTION

Accordingly, the present invention is directed to a dyed latex liquid developer composition which (a) a carrier liquid;
(b) a dyed latex;
(c) a charge director; and
(d) at least about 0.5% by weight of mineral oil, based on the total developer formulation.

DETAILED DESCRIPTION

As mentioned above, the liquid developers of the present invention have four (4) critical components.

The carrier liquid used in the present invention is preferably an aliphatic hydrocarbon carrier liquid having a conductivity of $10^{-9}$ SIEMENS/cm or less, a dielectric constant of 3 or less, a flash point of 35° C. or greater, and, preferably, a viscosity of 5 cps or less.

Such preferred carrier liquids are generally a mixture of $C_9$–$C_{11}$ or $C_9$–$C_{12}$ branched aliphatic hydrocarbons. The carrier liquid may be, for example, branched aliphatic hydrocarbons such as ISOPAR G, H, K, L, M, or V. These hydrocarbon liquids are narrow cuts of isoparaffinic hydrocarbon fractions with extremely high levels of purity. For example, the boiling range of ISOPAR G is between 157° and 176° C., ISOPAR H between 176° and 191° C., ISOPAR K between 177° and 197° C., ISOPAR L between 188° and 206° C., ISOPAR M between 207° and 254° C., and ISOPAR V between 254.4° and 329.4° C. ISOPAR L has a midboiling point of approximately 194° C. Stringent manufacturing specifications ensure that impurities, such as sulphur, acids, carboxyls, and chlorides, are limited to a few parts per million. They are substantially odorless, possessing only very mild paraffinic odor. They have excellent odor stability and are all manufactured by the Exxon Corporation. High purity normal paraffinic liquids NORPAR 12, NORPAR 13, and NORPAR 15, also manufactured by Exxon Corporation, may be used. These hydrocarbon liquids have the following flash points and auto-ignition temperatures:

| Liquid | Point (°C.) | Auto-Ignition Temp. (°C.) |
|---|---|---|
| NORPAR 12 | 69 | 204 |
| NORPAR 13 | 93 | 210 |
| NORPAR 15 | 118 | 210 |

All of these carrier liquids have vapor pressures at 25° C. of less than 10 Torr. ISOPAR G has a flash Point determined by the Tag Closed Cup method of 40° C. ISOPAR H has a flash point of 53° C. determined by ASTM D 56. ISOPAR L and ISOPAR M have flash points of 61° C. and 80° C., respectively, determined by the same method. While these are the preferred carrier liquids, the essential characteristics of all suitable carrier liquids are the high electrical volume resistivity, the dielectric constant, and flash point. In addition, a feature of these carrier liquids is a low Kauri-Butanol value, less than 30, preferably in the vicinity of 27 or 28, determined by ASTM D 1133.

The carrier liquid, when ready for use, generally is about 80% to about 99% by weight of the dyed latex developer formulation. More preferably, the ready-to-use carrier liquid constitutes about 85% to about 98% by weight of the dyed latex developer formulation. Most preferably, the ready-to-use carrier liquid constitutes about 90% to 96%. Of course, developer concentrates contain less carrier liquid (i.e., at least 70% by weight carrier liquid). The present invention contemplates both ready-to-use and concentrated forms.

The dyed latex of the present invention is a colloidal suspension of a synthetic resin in the carrier liquid. The present invention encompasses any and all dye latexes used in the liquid developer art including the dyed latexes first disclosed in the above-noted Kosel patents, as well as in U.S. Pat. No. 4,476,210, which issued to Croucher et al. on Oct. 9, 1984. The latter U.S. Patent is also incorporated herein by reference in its entirety. In particular, the dyed latex of the Present invention is the dispersed phase (i.e., dyed sterically stabilized thermoplastic resin particles) in the carrier liquid.

Such dyed latex particles of the present invention incorporate a dispersing agent, a fixative agent, and a colorant agent.

The dispersing agent portion of the dyed latex is preferably an amphipathic block or graft copolymer steric stabilizer which is prepared in an aliphatic dispersion medium (i.e, preferably, the carrier liquid) in the Presence of a free radical initiator. The preferred ingredients for this amphipathic steric stabilizer is lauryl methacrylate and glycidyl methacrylate is in the mole percent ratio range of about 98:2 to 90:10, more preferably, about 95:5. This copolymer is preferably a random copolymer made by vinyl addition polymerization in the carrier liquid. This reaction is initiated by any free radical initiator. A Preferred example of such an initiator is VAZ0-67, 2,2'-azo-bis-(2-methylbutyronitrile) supplied by DuPont.

This vinyl addition polymerization is preferably run at about 80° C. to about 105° C., more preferably about 90°-100° C. After completion of this copolymer, the dispersing agent is made by reacting that copolymer with methacrylic acid. The methacrylic acid groups react with oxirane groups on the glycidyl methacrylate moieties in the copolymer. The resulting soluble copolymer contains Pendent vinyl groups. This esterification reaction is generally carried out in the presence of the dispersing medium (e.g., the liquid carrier) and the presence of an effective catalytic amount of a catalystic agent. One preferred catalyst is dodecyldimethylamine.

This esterification reaction is preferably carried out from about 90° C. to about 135° C., more preferably, from 110°-130° C.

The preferred fixative agent portion of the dyed latex of the present invention is a thermoplastic resin which is insoluble in the carrier liquid. One preferred fixative agent is a copolymer of n-butyl acid maleate with vinyl acetate, preferably in about a 5:95 to 15:85 weight percent ratio.

Preferably, the above fixative agent copolymer is formed simultaneously with an attachment reaction of the fixative agent to the dispersing agent. This is accomplished by carrying out the copolymerization in the presence of the dispersing agent, the dispersing medium (e.g., carrier liquid), and a free radical initiator. The reaction is preferably carried out at a temperature of about 50° C. to about 80° C., more preferably from about 60° C. to about 70° C. The resulting nonaqueous dispersion has a portion which is soluble in the carrier liquid (e.g., the dispersion agent portion) and a portion which is not soluble (i.e., the fixative portion). During this polymerization procedure, the dispersing agent portion (amphipathic stabilizer) becomes intimately bound to the fixative agent (a synthetic resin particle). By intimately bound, we intend to define those chemical, as well as physical, interactions that irreversibly anchor the amphipathic stabilizer in such a way that it cannot leave the particle under normal operating conditions.

The colorant agent portion of the dyed latex of the present invention may be any suitable dye or combination of dyes useful in making these types of liquid developer formulations. The colorant agent and the nonaqueous dispersion produced above are mixed and heated together to a temperature of about 60°-80° C. until the dye is sufficiently reacted with, assimilated, bound up or absorbed into the fixative agent portion (or resin particles). The dye is preferably previously ground to very small particles before this mixing step. The dyes used herein are essentially insoluble in the carrier liquid. The resulting dyed latex dispersion preferably contains about 20-30% by weight solids and may be used as is in the developer composition of the present invention.

In some instances, it may be useful to substitute some or all of the dye with one or more pigments. Such a resulting latex is still termed a dyed latex for purposes of this invention.

The dyed latex solids generally constitute about 0.5% to 5% by weight of total developer composition. Preferably, the dyed latex solids constitute about 0.8% to 3% by weight, most preferably, about 1% to 1.5% by weight of total developer composition.

Any charge director used in latex-type developer compositions may be employed in the present invention.

One preferred charge director is ASA-3 antistatic additive for liquid hydrocarbons. This additive is believed to be comprised of 1-10 parts each of:

1. a chromium salt of a $C_{14-18}$ alkyl salicylic acid;
2. a calcium didecyl sulfosuccinate; and
3. a salt of the didecyl ester of sulfosuccinic acid and at least 50% of the basic nitrogen radicals of a copolymer of lauryl methacrylate, stearyl methacrylate, and 2-methyl-5-vinyl pyridine (also called 5-vinyl-2-picoline),said copolymer having a vinyl pyridine content of 20–30% by weight and an average molecular weight of 15,000–250,000.

A preparation of this additive is shown in U.S. Pat. Nos. 3,210,169 and 3,380,970 (both assigned to Shell Oil Company), both of which are incorporated herein by reference in their entireties.

A second known charge director composition is described in U.S. Pat. No. 4,869,991, which issued to Joseph deGraft-Johnson, Chi Ma, and Richard R.L. Wells on Sep. 26, 1989. That charge director composition is dispersed in a solvent and comprises:

A. a salt mixture comprised of 1-10 parts by weight each of:

(i) a chromium salt of a $C_{14-18}$ alkyl salicylic acid;

(ii) a calcium didecyl sulfosuccinate; and (iii) a salt of the didecyl ester of sulfosuccinic acid and at least 50% of the basic nitrogen radicals of a copolymer of lauryl methacrylate, stearyl methacrylate, and 2-methyl-5-vinyl pyridine, said copolymer having a vinyl pyridine content of 20–30% by weight and an average molecular weight of 15,000-250,000; and B. a salt-free copolymer of (i) laurylmethacrylate and (ii) a monomer selected from 2- or 4-vinylpyridine, styrene, and N,N-dimethylamino-ethylmethacrylate and mixtures thereof; said copolymer having a molecular weight from about 15,000 to about 100,000, and the weight ratio of monomers B (i) to B (ii) is from about 4:1 to 50:1, and wherein the weight ratio of B:A is from about 10:3 to about 40:3.

The charge director (as solution) generally constitutes about 0.5% to about 6% by weight of total liquid developer composition. Preferably, the charge director solution constitutes about 1% to 5% of total liquid developer composition. On a solids basis, the charge director solids generally constitute about 0.01% to 0.25% by weight of the total developer.

The mineral oil component of the liquid developer composition of the present invention may be any mineral oil (CAS No. 8020-83-5).

Mineral oils generally consist of completely saturated aliphatic and alicyclic hydrocarbons. They are characterized by chemical and biological inertness, nonpolar structure, hydrophobic nature, and excellent electrical properties. One preferred mineral oil is KLEAROL made by Witco. This mineral oil has a viscosity of 7–10 cSt at 40° C.; 50–60 SSU at 110° F.; and a flash point of 138° C. Another preferred one is Fisher brand mineral oil distributed by Fisher Scientific.

The mineral oil generally constitutes about 0.5% to 20% by weight of the liquid developer composition. More preferably, the mineral oil constitutes about 1% to about 10% by weight. Most preferably, the amount of mineral oil is about 2% to 5% by weight of the developer composition.

The present developer composition may contain additional optional ingredients as commonly used in the liquid electrophotographic developer art. Furthermore, the present developer composition may be combined with other types of toner particles (e.g., attritted toners) to form hybrid liquid developers such as described in the above-noted Kosel patents. Those hybrid-type developers will have improved cleanability properties.

The above-described developer ingredients may be combined according to any conventional blending method. The preferred blending method involves adding a dispersion of the dyed latex into the carrier liquid followed by adding the charge director and then the mineral oil. The ingredients are preferably thoroughly blended in a tank equipped with agitation means.

The following Examples and Comparative Examples further illustrate the present invention. All parts and percentages are by weight and all temperatures are Celsius unless explicitly stated otherwise.

EXAMPLE 1

Preparation of Latex Polymer Dispersion

The latex polymer was a graft-dispersion type polymer made in an aliphatic hydrocarbon solvent (ISOPAR G). It was made in three separate steps as follows:

Part A

Preparation of Dispersing Agent Precursor

Charge a 2-liter, round-bottomed flask fitted with reflux condenser, mechanical stirrer, thermometer, addition funnel, and means for introducing nitrogen with:

| | |
|---|---|
| 1. ISOPAR G (Exxon) | 910 grams. |
| To the addition funnel, add a monomer premix containing the following: | |
| 2. Lauryl methacrylate | 357.0 grams |
| 3. Glycidyl methacrylate | 12.0 grams |
| 4. VAZO-67 (DuPont) free radical initiator | 3.0 grams |

The system was purged at room temperature by evacuating (20–40 mm Hg) and replacing the head space with dry nitrogen. A slight positive pressure was maintained of nitrogen throughout the reaction. After purging to remove any dissolved oxygen, the flask was heating to 95°±3° C. with stirring, and the monomer premix was then added slowly. The addition should take 1 to 1.5 hours. After the addition was completed, the reaction mixture was heated for 4 hours.

Part B

Preparation of Dispersing Agent

To the above reaction product (Part A), at 95° C., the following was added:

| | |
|---|---|
| 5. Methacrylic Acid | 0.5 grams. |
| 6. Dodecyldimethylamine | 0.4 grams |

The reaction temperature was brought to 110° C. and heating continued with stirring for 10 hours. The reaction mixture was allowed to cool to room temperature and removed from reaction flask.

Part C

Formation of Fixative Agent and Attachment Thereto of Dispersing Agent

Recharge the reaction flask, described above, (without the addition funnel) with:

| | |
|---|---|
| 1. Part B | 43.0 grams |
| 2. ISOPAR G | 1,007.5 grams |
| 3. n-Butyl Acid Maleate (1) | 25.0 grams |
| 4. Vinyl Acetate | 222.0 grams |
| 5. VAZO-67 | 2.5 grams |

At room temperature, purge as above and heat the reaction mixture to 65° C. ±3° C. with stirring. Continue the reaction for 6 hours. Cool the reaction to room temperature and vacuum distill (1-2 mm Hg) until non-volatile solids are 30% ±1.0%. This product is the latex.

(1) n-Butyl Acid Maleate was made by heating maleic anhydride in n-butanol, as follows:

Charge a 250 ml round-bottom flask fitted with reflux condenser, mechanical stirrer, and thermometer with:

| | |
|---|---|
| 1. n-Butanol | 75 grams |
| 2. Maleic Anhydride | 100 grams |

Heat to 95° C., with stirring, and maintain for 4 hours. Cool the reaction mixture to room temperature.

EXAMPLE 2

Preparation of Dyed Latex

A mixture of 15.8 grams of Victoria Blue [C.I. 44045B](BASF), 6.1 grams of Auramine Yellow [C.I. 41000B](GAF), and 21.8 grams of Brown dye [C.I. 21010B](BASF) in 256 grams of ISOPAR H was pebble milled for 4 hours.

11.4 Grams of the above dye concentrate was added to 200 grams of the latex and 29 grams of ISOPAR H in a 400 beaker fitted with a thermometer and magnetic stirrer. The mixture was heated to 70° C. ±2° C. and held for 30 minutes, and the resulting dyed latex was cooled to room temperature.

EXAMPLE 3

Preparation of Positive Charge Director Solution

A solution of the charge director used in the Examples and Comparisons below was made according to the procedure set forth for Example 1 of U.S. Pat. No. 4,869,991 noted above.

EXAMPLES 4-7 AND COMPARATIVE EXAMPLES 1 AND 2

Iwatsu Pm-60 Platemaker With Different Levels of Mineral Oil

Developer Preparation

EXAMPLE 4

To a 10-liter stainless beaker, the following ingredients were added in the order shown. 5,000 mls ISOPAR G, 97.2 grams dyed latex, 80 grams charge director solution, and 20 grams mineral oil. The resulting mixture was mixed for 15-20 minutes with an ordinary lab mixer. The toner was aged for 24 hours before use.

EXAMPLE 5

To a 10-liter stainless beaker, the following ingredients were added in the order shown. 5,000 mls ISOPAR G, 97.2 grams dyed latex, 80 grams charge director solution, and 40 grams mineral oil. The resulting mixture was mixed for 15-20 minutes with an ordinary lab mixer. The toner was aged for 24 hours before use.

EXAMPLE 6

To a 10-liter stainless beaker, the following ingredients were added in the order shown. 5,000 mls ISOPAR G, 97.2 grams dyed latex, 80 grams charge director solution, and 80 grams mineral oil. The resulting mixture was mixed for 15-20 minutes with an ordinary lab mixer. The toner was aged for 24 hours before use.

EXAMPLE 7

To a 10-liter stainless beaker, the following ingredients were added in the order shown. 5,000 mls ISOPAR G, 97.2 grams dyed latex, 80 grams charge director solution, and 200 grams mineral oil. The resulting mixture was mixed for 15-20 minutes with an ordinary lab mixer. The toner was aged for 24 hours before use.

COMPARATIVE EXAMPLE 1

To a 10-liter stainless beaker, the following ingredients were added in the order shown. 5,000 mls ISOPAR G, 97.2 grams dyed latex, and 80 grams charge director solution. The resulting mixture was mixed for 15-20 minutes with an ordinary lab mixer. The toner was aged for 24 hours before use.

COMPARATIVE EXAMPLE 2

To a 10-liter stainless beaker, the following ingredients were added in the order shown. 5,000 mls ISOPAR G, 97.2 grams dyed latex, 80 grams charge director solution, and 10 grams mineral oil. The resulting mixture was mixed for 15-20 minutes with an ordinary lab mixer. The toner was aged for 24 hours before use.

Test Procedure Iwatsu PM-60 Platemaker

The platemaker was cleaned before use so that no toner deposits were left on any internal parts, including the upper and lower developing electrodes. Four liters of developer to be tested was then poured into the development tray. An Iwatsu Elefax target and master plate were used. Plates were made at the rate of 3 plates per hour, 24 hours a day. It took 8-9 days to complete 500 plates with no plates made over the weekend. At the end of the run, the developing compartment was opened and visually examined for toner deposits. Where toner deposits were noticed, an attempt was made to flush the deposits with a squirt bottle filled with ISOPAR G. If this failed, a cotton swab dipped in ISOPAR G was used to remove the deposits. If the deposits were not either wiped off, easily rubbed off, or rubbed off, then a wood scraper was used to scrape the deposits off. If that failed, then a pad soaked with a strong solvent (methylene chloride) was applied to remove the deposits. Using the criteria outlined below, each developer was judged according to the above described actions required to remove the toner deposits from the electrode plates and other parts:

5 Flushable
4 Wipeable
3 Easy Rubable
2 Rubable
30 1 Scrapeable
0 Solvent strippable After each Example or Comparison was tested and before the next developer was put into the development tray, the platemaker was cleaned so that no toner deposits were found anywhere. As can be seen in the Table below, the developers which contained at least 0.5% mineral oil cleaned easier than those developers containing less than that amount.

TABLE 1

| Ingredients | Comparative Example 1 | Comparative Example 2 | Example 4 | Example 5 | Example 6 | Example 7 |
|---|---|---|---|---|---|---|
| ISOPAR G | 5,000 mls | 5,000 mls | 5,000 mls | 5,000 mls | 5,000 mls | 5,000 mls |
| Dyed Latex | 97.2 gms | 97.2 gms | 97.2 gms | 97.2 gms | 97.2 gms | 97.2 gms |
| Charge Director Sol. | 80.0 gms. | 80.0 gms | 80.0 gms | 80.0 gms | 80.0 gms | 80.0 gms |
| Mineral Oil | 0.0 gms | 10.0 gms | 20.0 gms | 40.0 gms | 80.0 gms | 200.0 gms |
| % Level Mineral Oil | 0.0% | 0.25% | 0.5% | 1.0% | 2.0% | 5.0% |
| Cleanability Rating | 0 | 0 | 1 | 2 | 2 5 | |

EXAMPLES 8-10 AND COMPARATIVE EXAMPLES 3 AND 4 ITEK 613E/615E PLATEMAKER WITH DIFFERENT LEVELS OF MINERAL OIL

Developer Preparation

EXAMPLE 8

To a 10-liter stainless beaker, the following ingredients were added in the order shown. 6,000 mls ISOPAR G, 165 grams dyed latex, 124 grams charge director solution, and 23.8 grams mineral oil. The resulting mixture was mixed for 15-20 minutes with an ordinary lab mixer. The toner was aged for 24 hours before use.

EXAMPLE 9

To a 10-liter stainless beaker, the following ingredients were added in the order shown. 6,000 mls ISOPAR G, 165 grams dyed latex, 124 grams charge director solution, and 47.0 grams mineral oil. The resulting mixture was mixed for 15-20 minutes with an resulting mixture was mixed for 15-20 minutes with an ordinary lab mixer. The toner was aged for 24 hours before use.

EXAMPLE 10

To a 10-liter stainless beaker, the following ingredients were added in the order shown. 6,000 mls ISOPAR G, 165 grams dyed latex, 124 grams charge director solution, and 95 grams mineral oil. The resulting mixture was mixed for 15-20 minutes with an ordinary lab mixer. The toner was aged for 24 hours before use.

COMPARATIVE EXAMPLE 3

To a 10-liter stainless beaker, the following ingredients were added in the order shown. 6,000 mls ISOPAR G, 165 grams dyed latex, and 124 grams charge director solution. The resulting mixture was mixed for 15-20 minutes with an ordinary lab mixer. The toner was aged for 24 hours before use.

COMPARATIVE EXAMPLE 4

To a 10-liter stainless beaker, the following ingredients were added in the order shown. 6,000 mls ISOPAR G, 165 grams dyed latex, 124 grams charge director solution, and 11.9 grams mineral oil. The resulting mixture was mixed for 15-20 minutes with an ordinary lab mixer. The toner was aged for 24 hours before use.

Test Procedure Itek 613E/615E Platemaker

The developing electrodes (both upper and lower) were cleaned before use in each test so that no toner deposits were left. Four liters of the developer to be tested were put into the toner tank and 12 plates were made each hour, 7 hours a day. Each developer was run for 4 days. At the end of each test, the development compartment, including the electrodes, was visually examined for toner deposits. If toner deposits were noticed, they were first flushed with a squirt bottle filled with ISOPAR G. When this failed, a cotton swab dipped with ISOPAR G was used to remove the deposits. If the deposits were not wiped off, easily rubbed off, or rubbed off, then a wood scraper was used to scrape the deposits off. If that failed, then a pad soaked with a strong solvent (methylene chloride) was applied to remove the deposit. The ease of cleanability was judged according to the following criteria:

5 Flushable
4 Wipeable
3 Easy Rubable
2 Rubable
1 Scrapeable
0 Solvent strippable As can be seen in the Table below, the developers which contained at least 0.5% mineral oil cleaned easier than the developers containing less than that amount.

TABLE 2

| Ingredients | Comparative Example 3 | Comparative Example 4 | Example 8 | Example 9 | Example 10 |
|---|---|---|---|---|---|
| ISOPAR G | 5,000 mls | 6,000 mls | 6,000 mls | 6,000 mls | 6,000 mls |
| Dyed Latex | 165.0 gms | 165.0 gms | 165.0 gms | 165.0 gms | 165.0 gms |
| Charge Director Sol. | 124.0 gms. | 124.0 gms | 124.0 gms | 124.0 gms | 124.0 gms |
| Mineral Oil | 0.0 gms | 11.9 gms | 23.8 gms | 47.5 gms | 95.0 gms |
| % Level Mineral Oil | 0.0% | 0.25% | 0.5% | 1.0% | 2.0% |
| Cleanability Rating | 0. | 0 | 2 | 4 | 5 |

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A dyed latex liquid developer composition comprising:
   (a) a carrier liquid;
   (b) a dyed latex;
   (c) a charge director; and
   (d) at least about 0.5% by weight of mineral oil, based on the total developer composition.

2. The liquid developer composition of claim 1 wherein said carrier liquid is an aliphatic hydrocarbon carrier liquid having a conductivity of $10^{-9}$ SIEMENS/cm or less, a dielectric constant of 3 or less and a flash point of 35° C. or greater.

3. The liquid developer composition of claim 2 wherein said aliphatic hydrocarbon carrier liquid is a mixture of $C_9$–$C_{11}$ or $C_9$–$C_{12}$ branched aliphatic hydrocarbons.

4. The liquid developer composition of claim 1 wherein said dyed latex has a dispersing agent portion made up of a lauryl methacrylate/glycidyl methacrylate copolymer.

5. The liquid developer composition of claim 1 wherein said dyed latex has a fixative agent portion made from a vinyl acetate/n-butyl acid maleate copolymer.

6. The liquid developer composition of claim 1 wherein said charge director is a mixture of 1–10 parts lack of:

1. a chromium salt of a $C_{14-18}$ alkyl salicylic acid;
2. a calcium didecyl sulfosuccinate; and
3. a salt of the didecyl ester of sulfosuccinic acid and at least 50% of the basic nitrogen radicals of a copolymer of lauryl methacrylate, stearyl methacrylate, and 2-methyl-5-vinyl pyridine (also called 5-vinyl-2-Picoline) said copolymer having a vinyl pyridine content of 20–30% by weight and an average molecular weight of 15,000–250,000.

7. The liquid developer composition of claim 1 wherein said charge director is:

A. a salt mixture comprised of 1–10 parts by weight each of:

(i) a chromium salt of a $C_{14-18}$ alkyl salicylic acid;

(ii) a calcium didecyl sulfosuccinate; and (iii) a salt of the didecyl ester of sulfosuccinic acid and at least 50% of the basic nitrogen radicals of a copolymer of lauryl methacrylate, stearyl methacrylate, and 2-methyl-5-vinyl pyridine, said copolymer having a vinyl pyridine content of 20-30% by weight and an average molecular weight of 15,000-250,000; and B. a salt-free copolymer of (i) laurylmethacrylate and (ii) a monomer selected from 2- or 4-vinylpyridine, styrene, and N,N-dimethylaminoethylmethacrylate and mixtures thereof; said copolymer having a molecular weight from about 15,000 to about 100,000, and the weight ratio of monomers B (i) to B (ii) is from about 4:1 to 50:1, and wherein the weight ratio of B:A is from about 10:3 to about 40:3.

8. The liquid developer composition of claim 1 wherein said carrier liquid is about 80% to 99% by weight of said developer composition.

9. The liquid developer composition of claim 1 wherein said dyed latex solids is about 0.5% to 5% by weight of said developer composition.

10. The liquid developer composition of claim 1 wherein said charge director is about 0.5% to 6% by weight of said developer composition.

11. The liquid developer composition of claim 1 wherein said mineral oil is about 0.5% to 20% by weight of said developer composition.

12. The liquid developer composition of claim 1 wherein said mineral oil is about 1% to 10% by weight of said developer composition.

* * * * *